US009242153B2

(12) United States Patent
Jacquelot

(10) Patent No.: US 9,242,153 B2
(45) Date of Patent: Jan. 26, 2016

(54) GOLF BAG

(71) Applicant: BAGOLF Limited, Wanchai Hong-Kong (CN)

(72) Inventor: Bertrand Jacquelot, Vaux-le-Penil (FR)

(73) Assignee: BAGOLF Limited, Wanchai, Hong-Kong (CN)

( * ) Notice: Subject to any disclaimer, the term of this patent is extended or adjusted under 35 U.S.C. 154(b) by 58 days.

(21) Appl. No.: 14/178,339

(22) Filed: Feb. 12, 2014

(65) Prior Publication Data

US 2014/0312056 A1 Oct. 23, 2014

(30) Foreign Application Priority Data

Apr. 17, 2013 (FR) ..... 13 00904
Jun. 12, 2013 (FR) ..... 13 01340

(51) Int. Cl.
*G08B 13/14* (2006.01)
*A63B 55/00* (2015.01)

(52) U.S. Cl.
CPC ..... *A63B 55/00* (2013.01); *A63B 2055/001* (2013.01); *A63B 2209/08* (2013.01); *A63B 2220/56* (2013.01); *A63B 2220/833* (2013.01); *A63B 2225/50* (2013.01)

(58) Field of Classification Search
CPC ..... A63B 55/00; A63B 55/007; A63B 2055/001; A63B 2209/08; A63B 2210/50; A63B 2220/56; A63B 2220/833; A63B 2225/50; A63B 55/005; A63B 55/008; A63B 55/02; A63B 55/08; B01D 2255/20707
USPC ..... 340/568.6, 568.8, 675, 7.48, 323 R; 206/315.6, 315.3, 315.5, 278.1
See application file for complete search history.

(56) References Cited

U.S. PATENT DOCUMENTS

| | | | | |
|---|---|---|---|---|
| 4,029,136 | A | 6/1977 | Jacoby | |
| 4,200,131 | A | 4/1980 | Chitwood | |
| 4,746,014 | A | 5/1988 | Very | |
| 4,779,725 | A * | 10/1988 | Gerber | 206/315.3 |
| 5,238,109 | A | 8/1993 | Smith | |
| 5,730,285 | A | 3/1998 | Sheehan | |
| 6,321,805 | B1 * | 11/2001 | Suggs | 150/160 |
| 6,330,944 | B1 * | 12/2001 | DeMichele | 206/315.3 |
| 6,407,668 | B1 | 6/2002 | Beham | |
| 2004/0245133 | A1 | 12/2004 | Heidenreich | |
| 2004/0256259 | A1 | 12/2004 | Kawasaki | |
| 2005/0066876 | A1 | 3/2005 | Ritchey | |
| 2007/0012585 | A1 | 1/2007 | Sugarek | |
| 2011/0303568 | A1 * | 12/2011 | Reimers et al. | 206/315.6 |

FOREIGN PATENT DOCUMENTS

CN 200 960 382 10/2007

* cited by examiner

*Primary Examiner* — Daniel Previl
(74) *Attorney, Agent, or Firm* — Young & Thompson

(57) ABSTRACT

A golf bag includes at least one pouch for containing at least two golf clubs, each club having a shaft of length Lcg, a cross-section having an area of a given value, and a club head secured to one end of the shaft, the pouch being of oblong shape defined along a longitudinal axis and including a bottom and an opening situated at the end of the pouch remote from the bottom, substantially centered on the axis, the opening having a rim of given shape and an area greater than the sum of the two areas of the cross-sections of the two shafts, the depth of the pouch defined along the axis from the opening having a value that is not less than Lcg; a bearing surface; and elements for mounting the bearing surface in the pouch at a distance from the opening that is less than the value Lcg.

23 Claims, 3 Drawing Sheets

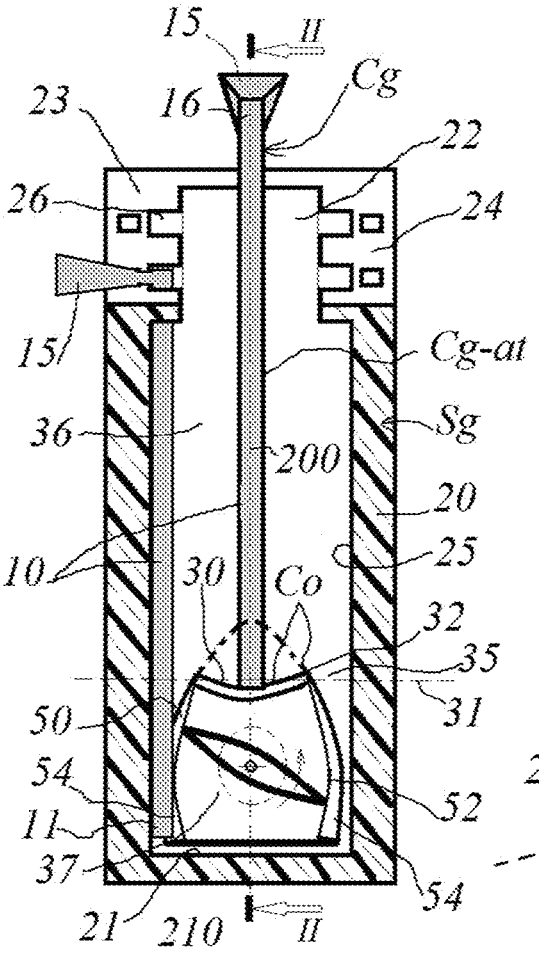
Fig. 1
Fig. 2
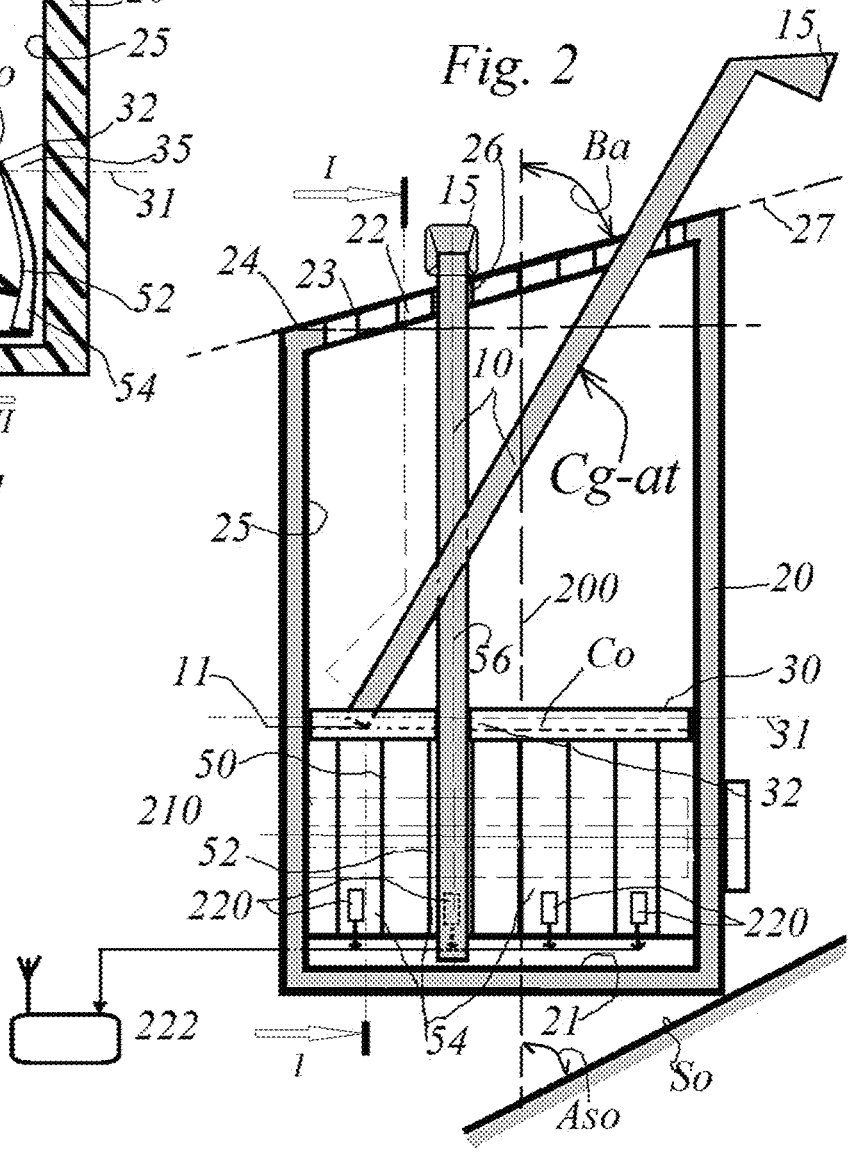

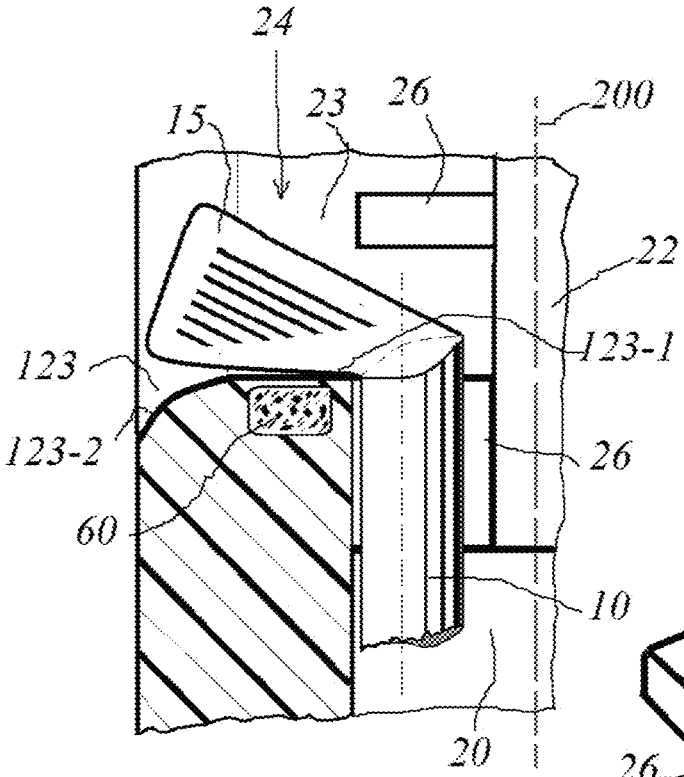
Fig. 4
Fig. 3
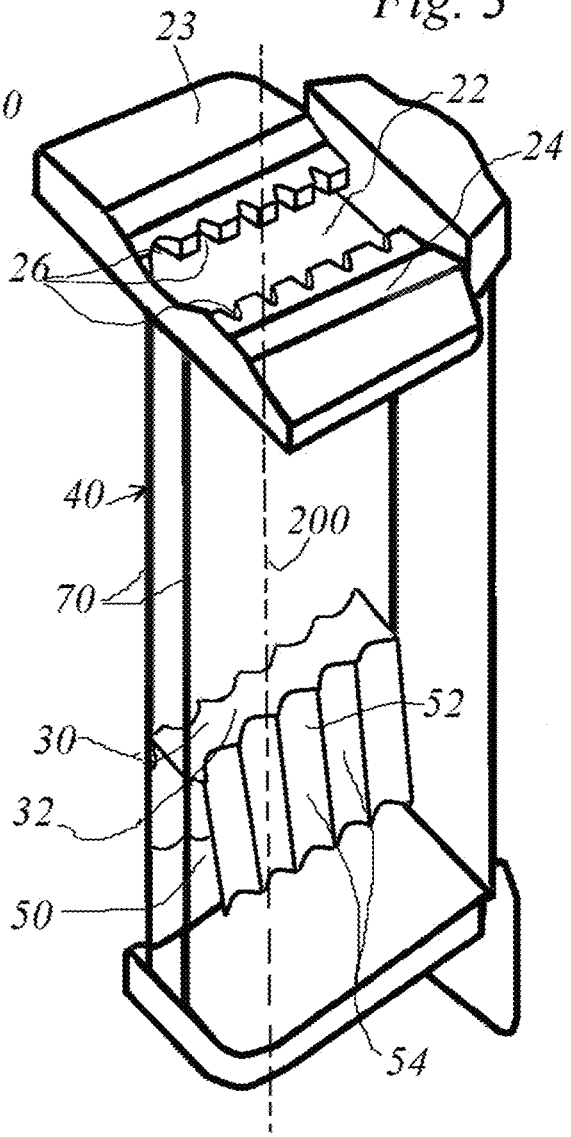

Fig. 5
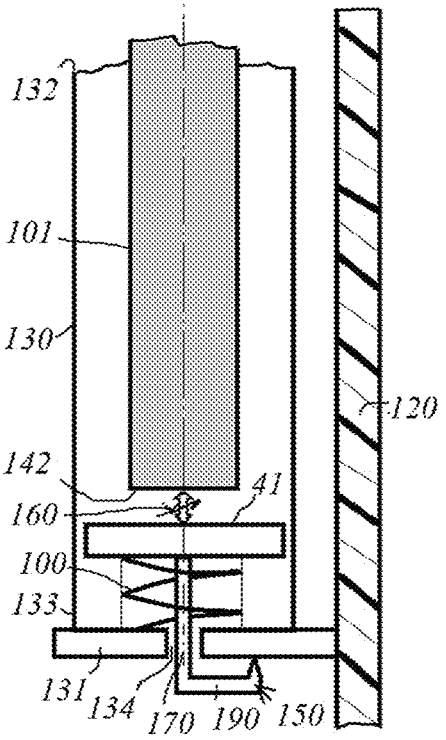
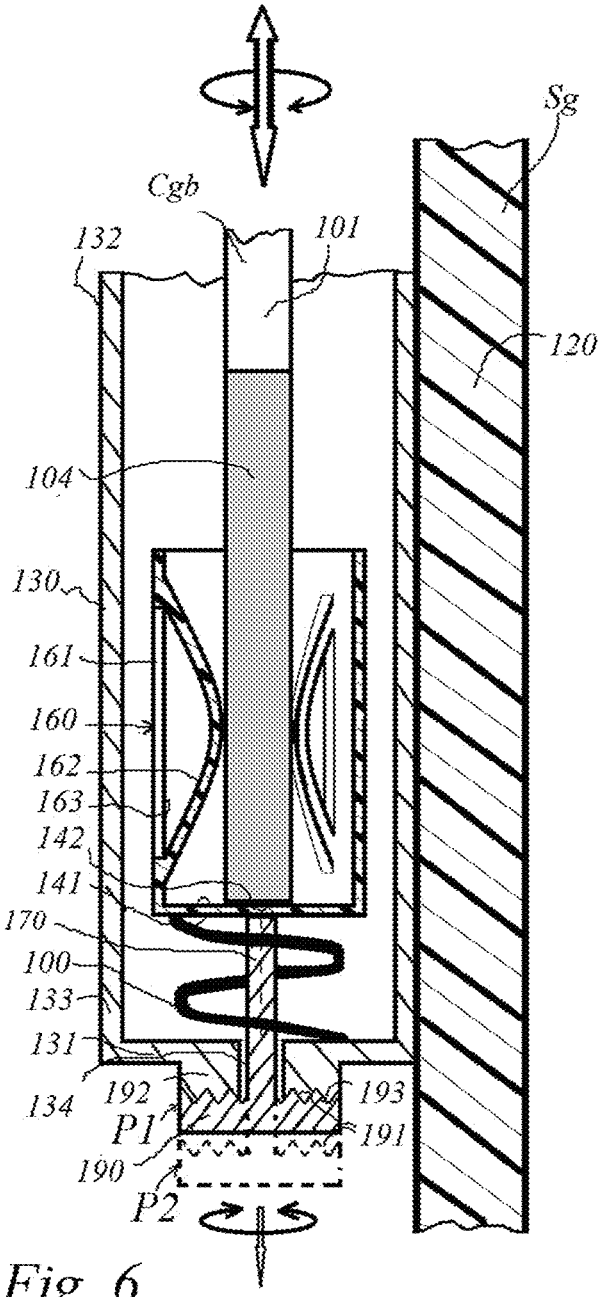
Fig. 6
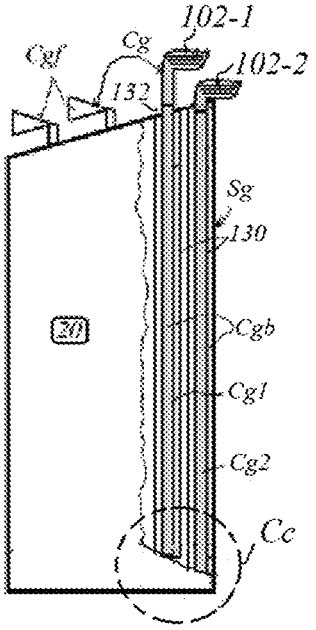
Fig. 7

GOLF BAG

FIELD OF THE INVENTION

The present invention relates to a golf bag, i.e. to a bag comprising an oblong pouch having a bottom and an opening remote from the bottom, which bag is suitable for containing golf clubs that may equally well be irons or woods, each club being constituted by a shaft, grip means mounted in co-operation with one end of the shaft, a ferrule secured to the second end of the shaft, and a club head secured to the ferrule.

BACKGROUND OF THE INVENTION

Golf bags are already known such as those described in US 2004/245133, U.S. Pat. No. 6,407,668, and U.S. Pat. No. 4,746,014. Such a prior art bag essentially includes a golf club support comprising a solid part having at least one groove formed in one of its sides for the purpose of receiving a golf club shaft, and a hollow housing formed in another side for receiving the head of the golf club.

Such an embodiment undeniably produces the desired results, however it presents drawbacks, in particular for golfers who carry their own golf bags, since it is relatively bulky, massive, and heavy. In addition, its structure makes the golf bag relatively unattractive and above all not very practical to use on a golf course, whether while the player carrying it is walking, or while stowing clubs. It also makes the golf bag relatively expensive.

SUMMARY OF THE INVENTION

Thus, an object of the present invention is to provide a golf bag that mitigates the drawbacks of prior art golf bags and that is more ergonomic for its users.

More precisely, the present invention provides a golf bag comprising:

at least one pouch suitable for containing at least two golf clubs, each club being constituted by a shaft of length Lcg and of cross-section having an area of a given value, and by a club head secured to one end of the shaft, said pouch being of oblong shape defined along a longitudinal axis and comprising a bottom and an opening situated at the end of the pouch that is remote from the bottom, being substantially centered on said longitudinal axis, said opening having a rim of given shape and having an area that is greater than the sum of the two areas of the cross-sections of the two shafts, the depth of the pouch defined along the longitudinal axis from said opening having a value that is not less than Lcg;

a bearing surface; and means for mounting said bearing surface in said pouch at a distance from said opening that is less than the value Lcg, said bearing surface having a section, as seen from the opening, that is smaller than the cross-section of the inside wall of said pouch as defined in a first plane perpendicular to said longitudinal axis, at least a portion of the edge of the bearing surface being situated at a distance from the inside wall of said pouch as defined in said first plane that is substantially equal to the value of the thickness of a shaft so that said shaft is suitable for passing between said bearing surface and the inside wall of said pouch when it is substantially parallel to said longitudinal axis of said pouch.

BRIEF DESCRIPTION OF THE DRAWINGS

Other characteristics and advantages of the present invention appear from the following description given by way of non-limiting illustration and with reference to the accompanying drawings, in which:

FIGS. 1 and 2 are diagrammatic longitudinal sections showing an embodiment of a golf bag of the invention, FIG. 1 being a section on line I-I in FIG. 2 and FIG. 2 being a section on line II-II in FIG. 1;

FIGS. 3 and 4 are respectively a section view and an isomeric view of an embodiment of a possible embodiment detail of the golf bag of the invention as shown in FIGS. 1 and 2;

FIG. 5 is a diagram of a portion of another embodiment of the golf bag of the invention;

FIG. 6 is a diagrammatic fragmentary view of an improved preferred embodiment of the golf bag in the embodiment shown in FIG. 5; and FIG. 7 is an overall view of the golf bag in accordance with the embodiment shown in FIGS. 5 and 6, FIG. 6 being a section view of the portion of FIG. 7 in a circle Cc and on a larger scale than FIG. 7.

DETAILED DESCRIPTION OF THE INVENTION

With reference to the accompanying figures, the present invention relates to a golf bag Sg suitable for containing at least two golf clubs Cg, e.g. of the "iron" type.

The golf bag Sg has at least one pouch 20 suitable for containing at least two golf clubs Cg, each club being constituted by a shaft 10 of length Lcg with a cross-section having a maximum area of a given value, and a club head 15 secured to one end 16 of the shaft.

The pouch is of oblong shape defined along a longitudinal axis 200 and comprises a bottom 21 and an opening 22 situated at the end 24 of the pouch 20 that is remote from the bottom 21, being substantially centered on the longitudinal axis 200. The opening thus defines a rim 23 of given shape and of an area that is greater than the sum of the two areas of the maximum cross-sections of two shafts. The depth of the pouch, defined along the longitudinal axis 200 from the opening 22 has a value of not less than Lcg.

The bag also has a bearing surface 30 and mounting means 40 for mounting the bearing surface 30 in the pouch 20 at a distance from the opening that is less than the value Lcg. The bearing surface 30 presents a section, as seen from the opening 22, that is smaller than the cross-section of the inside wall 25 of the pouch 20 as defined in a first plane 31 perpendicular to the longitudinal axis 200, at least a portion 32 of the edge of this bearing surface 30 being situated at a distance from the inside wall 25 of the pouch 20, as defined in this first plane 31, that is not less than the value of the thicknesses of a shaft 10, or indeed substantially equal thereto, so that the free end 11 of the shaft can be inserted into the pouch 20, as shown in the left-hand portion of FIG. 1, by having its free end passed in succession into the volume 36, the empty space 35, and the volume 37, so as to stow the club Cg in the bag, as explained below.

In still more preferred manner, the golf bag also has a flexible-rigid skirt 50, see FIGS. 1, 2, and 3, that is secured to the above-mentioned portion of the edge 32 of the bearing surface 30 and that extends towards the bottom 21 of the pouch 20, advantageously with a curved shape arranged so that the distance between it and the inside wall 25 of the pouch is, at at least one point 52, less than the value of the thickness of the shaft 10 when the shaft is placed in the pouch 20 and the club head 15 rests on the rim 23, FIGS. 1 and 2.

In a very advantageous embodiment that makes the golf bag even more practical, the rim 23 of the opening 22 has at least two notches 26 for receiving the respective shafts 10 of two clubs, and the skirt 50 includes in corresponding manner, i.e. substantially on the straight lines 56 passing respectively through these notches 26, two troughs 54 made in the skirt 50 and suitable for having the free ends 11 of the shafts slidably received in respective ones thereof, the other ends 16 of the shafts being received in respective ones of the notches 26, so that the shafts (generally in the vicinity of their grips) are resiliently clamped between the skirt 50 and the inside wall 25 of the pouch 20, and more particularly at the above-defined point 52.

The bag advantageously also includes controllable means for varying the distance between the skirt 50 and the inside wall 25 of the pouch 20. In very preferred manner, these controllable means for varying the distance between the skirt and the inside wall of the pouch are constituted by a cam 210 shown in continuous lines in FIG. 1 and in dashed lines in FIG. 2, the cam being mounted to pivot relative to the skirt, e.g. on a wall of the pouch 20 or on a frame 70 as defined below with reference to FIG. 3, the cross-sectional shape of the cam 210 being elliptical or the like, for example, such that on being turned it presses against the skirt 50 in order to deform it and urge it towards the inside wall 25 of the pouch 20, thereby firmly holding at least one of the two shafts 10 when slid into a trough 54 and clamped between the skirt 50 and the inside wall of the pouch, thereby making it possible for example to transport, move, manipulate, etc. the golf bag in complete safety and under all circumstances without any fear of one or more clubs escaping from the pouch 20.

Furthermore, in order to enable the golfer to know the time taken to play such and such a portion of a course, the number of times that such and such a club has been used, etc., e.g. so as to monitor golfing performance closely, the bag advantageously also includes means for detecting the presence or the absence of a shaft 10 in a trough 54. In a most preferred embodiment, and, by way of example, in order to be connectable to a computer or the like these means for detecting the presence or the absence of a shaft 10 in a trough 54, and preferably the presence or the absence of all of the clubs in their respective troughs, comprise both a pressure sensor 220 arranged in association with the trough 54, the pressure sensor, such as a strain gauge or the like, being suitable for issuing a signal when a shaft 10 is in the trough 54, and also a signal transceiver member 222, this member being suitable for communicating with a computer or the like, e.g. by WiFi, radio link, or the like.

In most preferred manner, and as shown in FIG. 1, the bearing surface 30 presents a shape that is concave, drawn in continuous lines in FIG. 1, with its concave side Co facing towards the opening 22. The function of this concave side is explained below.

However, in another application, this bearing surface 30 may be of convex shape, as shown in dashed lines in FIG. 1, with its convex side Co facing towards the opening 22. The function of this convex side is also explained below.

In addition, and in very advantageous manner, the plane in which the opening 22 is defined, which plane is defined as the second plane 27 in FIG. 2, is at an angle Ba relative to the longitudinal axis 200, which angle is of a value lying substantially in the range fifty-five degrees to seventy-five degrees, optionally and preferably being equal to sixty-five degrees, so that when the golf bag is resting in conventional manner on the substantially horizontal ground So (FIG. 2) via a tripod of any type (not shown), its longitudinal axis 200 is at an angle Aso of about thirty degrees to forty degrees relative to the ground and the second plane 27 is substantially horizontal or the like in order to make it easier to take hold of golf clubs via their heads 15.

In very advantageous manner, and as shown more particularly in FIG. 4, the portion 123 of the rim 23 of the opening 22 including at least two notches 26 is formed by a first part 123-1, beside the opening 22, that is substantially plane and perpendicular to the longitudinal axis 200, and a second part 123-2 contiguous with the first part 123-1 so that the first part lies between the opening and the second portion, the face of this second part sloping relative to the plane of the first part 123-1, preferably with a curved shape so as to make it easier to take hold of the head 15 of the golf club Cg in the hand.

In even more preferred manner, in order to ensure that golf clubs having heads 15 made of magnetic material are held even better, the bag of the invention includes two magnets 60 embedded in the first part 123-1 of the rim portion 123 (see FIG. 4) in register with respective ones of the two notches 26 so that when the shafts of the golf clubs Cg are placed in the pouch 20 and their club heads 15 are resting on the rim 23, their heads are situated close to a magnet and are subjected to attraction therefrom.

In a preferred embodiment that is practical from an industrial point of view, in order to mount the bearing surface 30 in the pouch 20 at a distance from the opening that is less than the depth of the pouch, the above-defined means 40 are constituted by a frame 70 (see FIG. 3) and by connection means, e.g. welding, adhesive, mutual engagement, crimping, etc., for securely connecting the frame 70 to the bearing surface 30 and to at least one of the following elements: the rim 23 of the opening 22; the bottom 21 of the pouch 20; and the inside wall 25 of the pouch 20.

In a particularly preferred embodiment, as shown in the figures, the shape given to the rim 23 of the opening 22 is substantially that of a quadrilateral, preferably and optionally a rectangle, having at least one side, and preferably and optionally one long side when the quadrilateral is a rectangle, that makes an angle relative to the longitudinal axis 200 that is equal to the above-defined given angle Ba, the two notches 26 being made in this side.

Nevertheless, since a golf bag is in fact suitable for containing more than two clubs, the opening 22 is preferably rectangular, and under such circumstances a plurality of notches 26 are made respectively in both long sides of this rectangular shape, thus making it possible to stow a plurality of clubs on both sides of the opening, because the side 24 slopes relative to the longitudinal axis 200.

As a consequence of this arrangement and since the slopes of the striking faces of the club heads (i.e. their "lofts") lie in the range nineteen degrees to sixty-four degrees relative to the axes of the shafts, the club heads can be positioned almost perpendicularly to this side 24, thereby creating spacing between the heads that makes it easier for golfers to take hold of them in the hand.

The above-described golf bag shown in FIGS. 1 to 4 is used as follows:

Before using the bag to play a round of golf, the golfer begins by stowing all of the clubs Cg therein, in their "stowage" positions, for example.

To do this, the golfer takes each club one by one, e.g. in increasing order of their "lofts", and each club is put into place in the bag by pushing the free end 11 of its shaft into the pouch 20 as far as the trough 54 that matches the notch 29 in which the end 16 of the club is to be positioned. In advantageous manner, each notch may be associated with a club reference that is written on the rim 23, giving a "loft" value.

The shaft 10 engaged in the corresponding trough 54 is clamped between the inside wall 25 of the pouch 20 and the skirt 50. It is also securely held in its notch 26 and it is prevented from pivoting by the effect of a magnet 60 attracting the head 15 of the club when it is made of a magnetic material such as iron, thus preventing the heads from banging against one another.

The same applies to all of the golfer's clubs.

The golfer can then very easily extract the club needed at each stage of a round, by taking hold of its head 15, with the original structure of the bag of the invention as described above making this operation much easier.

Once the stroke has been played, the golfer can put the club back into place in its stowage position as described above.

Nevertheless, most golfers use the same club several times in succession, naturally after going along a portion of the course and finding the ball that was hit at the preceding stroke.

Under such circumstances, the structure of the golf bag of the invention can make it unnecessary to put the club back into the stowage position in which it is held securely. The structure of the bag enables the golfer to place the club in a standby position as shown in FIGS. 1 and 2 for the club shown diagrammatically at Cg-at. To place the club in the standby position, it suffices to insert the shaft 10 into the pouch 20 until its free end 11 comes to rest on the bearing surface 30 which is then of concave shape. In this position, the portion of the shaft close to the club head rests on the rim of the opening 22 (a short side for an opening that is rectangular) and its free end 11 rests in the hollow of the concave face of the bearing surface. The club is thus held quite well in the bag, in a manner that suffices and that is different from the other clubs which are in the stowage position, until the golfer uses it again for the next stroke.

The value of the above-defined distance Lcg between the bearing surface 30 and the opening 22 of the bag is such as to ensure that a club in the standby position projects clearly from the opening of the bag so the golfer can take hold of it very easily in order to play the next stroke.

As mentioned above, it is possible for the bearing surface to be convex instead of being concave. In this configuration, it does not serve genuinely to support a club as described above. In contrast, it enables the free ends of the clubs to be guided for stowage between the wall of the bearing surface 30, more precisely the skirt 50, and the inside wall 25 of the pouch 20, as explained above.

The present invention also relates to a golf bag Sg suitable for containing, as is necessary, at least one golf club Cgb of the "wood" or analogous type, as can be seen in the accompanying figures and more particularly in FIGS. 5 to 7.

A golf club of the "wood" type is likewise constituted by a shaft 101 and a head 102 secured to a first end 103 of the shaft 101, the second end 104 of the shaft being a free end and including grip means.

A wood Cgb has a head that is more voluminous and sometimes heavier than the head of an iron Cgf, so golf bags are generally designed so that both categories of club can be received in two stowage spaces that are different and spaced apart to a greater or lesser extent, see FIG. 7.

As described above, a golf bag has a pouch 120 of generally oblong shape, optionally with a first compartment for receiving irons Cgf and a second compartment for receiving woods Cgb.

This second compartment for the woods Cgb is generally constituted by a set of substantially cylindrical receiver tubes 130 that are grouped beside one another for reasons of available space.

Such a receiver tube 130 is suitable for having the shaft 101 of the golf club Cgb engaged therein. As a result it is shaped in such a manner that when the shaft is engaged therein, the head 102 of the club emerges via a first end 133 of the receiver tube.

Means are also provided for securing the receiver tube(s) 130 to the pouch 120, regardless of whether the tubes are made inside and on one side of the pouch 120, or outside the pouch, e.g. being juxtaposed on the outside wall of the pouch.

These means may be of any type, for example they may be constituted by a plate that is secured both to the wall of the pouch 120 and to the tubes.

The golf bag has at least one receiver tube 130 suitable for having the shaft 101 of a golf club of the wood type Cgb engaged therein (see FIGS. 5 to 7 taken in combination with FIGS. 1 to 4), and having first and second ends 132 and 133. The receiver tube 130 is shaped so that when the shaft 101 of the golf club is engaged therein, the head 102 of the golf club emerges from its first end 132. Means are also provided for securing the receiver tube 130 to the pouch 120.

The golf club also has an abutment 141, e.g. a rigid plate or the like, and means for mounting the abutment to move in translation in the receiver tube 130 and relative thereto so as to be suitable for taking up any position between a first position P1 and a second position P2 (see FIG. 6), the first position P1 being the position in which the abutment 141 is subjected to a presser force less than a predetermined value and the second position P2 being the position in which the abutment 141 is subjected to a presser force greater than the same predetermined value.

An embodiment of means for generating this presser force of determined value is described below.

The golf bag may also include a pusher 142 arranged to co-operate by contact with the abutment 141.

The pusher 142 is very advantageously constituted by a portion of the shaft 101, and it is arranged relative to the shaft in such a manner that when the shaft 101 of the club Cgb is engaged in the receiver tube 130, it comes into contact with the abutment 141 so that it causes the abutment 141 to go from its first position P1 to its second position P2 (see FIG. 6), e.g. pressing manually on the head 102 of the club.

The second position P2 of the abutment 141 is the position occupied by the abutment 141 when it is subjected to a presser force greater than the predetermined value being applied by the pusher 142.

In very preferred manner, the pusher 142 is constituted by the free end face of the golf club 101, as shown in FIG. 6.

The golf bag Sg also has means for mounting the abutment 141 to turn relative to the receiver tube 130 and means 150 for preventing the abutment 141 turning relative to the receiver tube 130 while it is in its first position P1.

In a preferred embodiment, the golf bag also has means 160 for releasably engaging the shaft 101 with the abutment 141. These means for engaging the shaft 101 with the abutment 141 serve essentially to hold the shaft relative to the abutment and to enable the shaft to be disengaged from the abutment without giving rise to any damage whatsoever to the bag or to the shaft.

This preferred embodiment of the releasable connection means 160 is described below with reference to FIG. 6.

These means are very advantageously constituted by a sleeve 161 of inside diameter greater than the diameter of the second end 104 of the shaft 101, so that the second end is suitable for being engaged inside the sleeve, means for securing the sleeve to the abutment 141, e.g. by making the sleeve and the abutment as a single piece of plastics material, of metal, or the like, and at least one spring 162 secured to the inside wall 163 of the sleeve 161, e.g. a spring blade under tension in the form of an arch and likewise made integrally with the sleeve 161, in such a manner that the spring 162 is compressed when the second end 104 of the shaft 101 is engaged in the sleeve 161 and then tends by elastic reaction to press the second end of the shaft against the inside wall of the sleeve 161.

In another embodiment that is even more preferred, these connection means 160 comprise at least three springs 162 distributed substantially at one hundred twenty degrees from one another on the inside wall 163 of the sleeve 161. Only two of these three springs 162 are visible in FIG. 6 which is a diagrammatic longitudinal section view of the portion of the bag including these connection means 160.

In another preferred embodiment, the means for mounting the abutment 141 to move in translation inside the receiver tube 130 and relative thereto, and also the means for mounting the abutment 141 to turn relative to the receiver tube 130, are combined and are constituted by an end wall 131 closing the second end 133 of the receiver tube 130, a through orifice 134 made in the end wall 131, and a pin 170 secured to the abutment 141, which pin is arranged to be capable both of sliding in translation and of turning in the through hole 134.

The means 150 for preventing the abutment 141 from turning relative to the receiver tube 130 while it is in its first position P1 are very advantageously constituted by an endpiece 190 secured to the pin 170 and including, on a face 191, at least one of the following catches: a male catch; a female catch; and a ring 192 having on a face 193 a plurality of catches that are complementary to the at least one catch of the endpiece 190, and means for mounting the ring 192 around the through orifice 134 and secured to the receiver tube 130.

The endpiece 190 and the ring 192 are arranged in such a manner that when the abutment 141 is in its first position P1 (drawn in continuous lines in FIG. 6), the at least one catch of this endpiece co-operates by engaging with one of the notches of the plurality of notches in the ring to prevent the endpiece 190 from turning relative to the ring 192, and when the abutment 141 is in its second position P2 (drawn in dashed lines in FIG. 6), the at least one catch of the endpiece 190 no longer co-operates by engagement with any of the catches of the plurality of catches in the ring 192, thereby allowing the endpiece 190 to turn relative to the ring 192.

In a very preferred embodiment, in order to facilitate fabrication of the golf bag as shown in FIG. 6, the endpiece 190 is secured to the pin 170 so as to be situated outside the receiver tube 130 and so that its face 191 having the at least one catch faces towards the end wall 131, and the ring 192 is secured to said end wall outside the receiver tube 130 so that its face 193 having the plurality of catches complementary to the at least one catch of the endpiece 190 faces the face 191 of the endpiece 190 including the at least one catch.

In still more preferred manner, in order to facilitate using the golf bag, the bag has means for generating a resilient force between the abutment 141 and the receiver tube 130. These means are advantageously constituted by a helical spring 100 mounted between the abutment 141 and the end wall 131, surrounding the pin 170, as shown in FIG. 6. The force generated by the spring 100 in its rest position (see FIGS. 5 and 6) when the abutment 141 is in its position P1 then determines the above-defined value for the predetermined pressure in this embodiment of the golf bag Sg.

The golf bag as described above and shown more particularly in FIGS. 5 and 7 is used as follows:

Firstly it is assumed that:

- the golf bag has two receiver tubes 130 (FIG. 7), each housing a wood type golf club Cg1, Cg2, the head 102-1 of the wood type club Cg1 being at a level situated above the head 102-2 of the wood type club Cg2 by a determined quantity that is sufficient to obtain the results defined below;
- the two shafts of these two wood type clubs Cg1, Cg2 are held in their respective receiver tubes 130 by the releasable connection means 160, as described above; and
- the abutment 141 of each receiver tube 130 is prevented from turning by the catch of its endpiece 190 being engaged in one of the catches of the plurality of catches of the ring 192.

It should then be assumed that the player seeks to take hold of the wood type club Cg2 without the head 102-2 of this club coming into abutment against the head 102-1 of the wood type club Cg1.

To do this, the player begins by pressing on the head 102-1 of the club Cg1 against the force exerted by the spring 100 so as to push the shaft 101 of this club Cg1 into its receiver tube 130. Under this thrust, the abutment 141 is moved in translation so as to compress the spring 100, the corresponding movement in translation of the shaft 170 causing the catch of the endpiece 190 to be separated from a catch of the ring 192.

While continuing to apply this thrust on the head 102-1 of the club Cg1, the user turns the head 102-1 through an angle that is sufficient to ensure it is no longer situated over the head 102-2 of the club Cg2, thus allowing the club Cg2 to be extracted from its receiver tube without the head 102-2 coming into abutment against the head 102-1 of the golf Cg1.

After the club Cg2 has been extracted, the user may either return the club Cg1 to its initial position, or else the user may block it temporarily in this pivoted position while making use of the club Cg2.

Regardless of its position, the wood Cg1 is blocked merely by releasing the thrust exerted on its head 102-1, with expansion of the spring 100 leading to co-operation between the catch of the endpiece and a catch of the ring.

The above description of the use of the golf bag of the invention is given in association with two receiver tubes and two wood type clubs Cg1, Cg2. However it is clear that this use is applicable to a golf bag having a compartment with more than two receiver tubes 130, each receiving a wood type club 101. It suffices for the receiver tube to be shaped so that the heads 102 of the woods are staged at different levels.

The invention claimed is:

1. A golf bag (Sg) comprising:

at least one pouch (20) suitable for containing at least two golf clubs (Cg), each club being constituted by a shaft (10) of length Lcg and of cross-section having an area of a given value, and by a club head (15) secured to one end (16) of the shaft (10), said pouch being of oblong shape defined along a longitudinal axis (200) and comprising a bottom (21) at a first end of the pouch and an opening (22) situated at an opposite, second end (24) of the pouch (20), said opening (22) being substantially centered on said longitudinal axis (200), said opening having a rim (23) of given shape and having an area greater than a sum of the two areas of the cross-sections of the two shafts, a depth of the pouch defined along the longitudinal axis (200) from said opening (22) having a value not less than Lcg;

a bearing surface (30); and means (40) for mounting said bearing surface (30) in said pouch (20) at a distance from said opening less than the value Lcg, said bearing surface (30) having a section, as seen from the opening (22), smaller than the cross-section of an inside wall (25) of said pouch (20) as defined in a first plane (31) perpendicular to said longitudinal axis (200), at least a portion (32) of an edge of the bearing surface (30) being situated at a distance, from the inside wall (25) of said pouch (20) as defined in said first plane (31), substantially equal to the value of the thickness of a shaft (10) and allowing said shaft to pass between said bearing surface (30) and the inside wall (25) of said pouch (20) when the shaft is substantially parallel to said longitudinal axis (200) of said pouch.

2. A golf bag according to claim 1, further comprising a flexible-rigid skirt (50) secured to said edge portion (32) of the bearing surface (30) and extending towards the bottom (21) of said pouch (20) with a curved shape, a distance between the flexible-rigid skirt (50) and the inside wall (25) of said pouch, at least at a point (52), is less than the value of said thickness of the shaft (10) when the shaft is placed in said pouch (20) and said club head (15) is resting on said rim (23).

3. A golf bag according to claim 2, wherein the rim (23) of said opening (22) includes at least two notches (26) for receiving the two shafts (10) respectively, said skirt (50) including two troughs (54) in in-line correspondence with respective ones of said two notches (26), the two troughs (54) being suitable for slidably receiving the two respective shafts when the two shafts are in their respective notches (26) in order to clamp the two shafts between said skirt (50) and the inside wall (25) of the pouch (20).

4. A golf bag according to claim 3, further comprising controllable means for varying the distance between the skirt (50) and the inside wall (25) of the pouch (20).

5. A golf bag according to claim 4, wherein the controllable means for varying the distance between the skirt and the inside wall of the pouch are constituted by a cam (210) rotatably mounted relative to said skirt, the cross-section of said cam being shaped to provide that on turning the cam bears against said skirt (50) to move the cam towards the inside wall of the pouch and thus block at least one of the two shafts (10) when the cam is slidably received in a trough (54) and clamped between the skirt (50) and the inside wall of the pouch.

6. A golf bag according to claim 3, further comprising means for detecting the presence or absence of one of the shafts (10) in at least one trough (54).

7. A golf bag according to claim 6, wherein the means for detecting the presence or absence of the one shaft in at least one trough comprises a pressure sensor (220) arranged in said trough (54), said pressure sensor being suitable for issuing a signal when the one shaft (10) is in said trough (54), and a transceiver member (222) for transmitting said signal.

8. A golf bag according to claim 3, wherein the plane in which said opening (22) is defined, referred to as a second plane (27), is at an angle Ba relative to said longitudinal axis (200), the angle Ba having a value lying substantially in the range fifty-five degrees to seventy-five degrees.

9. A golf bag according to claim 8, wherein the shape given to the rim (23) of said opening (22) is substantially a quadrilateral, having at least one side, at an angle relative to said longitudinal axis (200), which angle is equal to said given angle Ba, said two notches (26) being made in said side.

10. A golf bag according to claim 3, wherein the portion (123) of the rim (23) of said opening (22) that includes said two notches (26) is made up of a substantially plane first part (123-1) beside said opening (22) and perpendicular to said longitudinal axis (200), and a second part (123-2) contiguous with the first part (123-1), the first part is situated between the opening and said second part (123-2), the face of said second part sloping relative to the plane of said first part (123-1).

11. A golf bag according to claim 10, further comprising at least one magnet (60) embedded in said first part and in correspondence with a notch (26) with the head (15) of said club situated in the proximity of said magnet when the shaft of said club (Cg) is placed in said pouch (20) and the head (15) is resting against said rim (23).

12. A golf bag according to claim 1, wherein said bearing surface (30) presents at least one of the following shapes: concave with a concave side facing towards said opening (22); and convex with a convex side facing towards said opening (22).

13. A golf bag according to claim 1, wherein the means (40) for mounting said bearing surface (30) in said pouch (20) are constituted by a frame (70) and by connection means for securely connecting said frame (70) to the bearing surface (30) and to at least one of the following elements: i) the rim (23) of said opening (22); ii) the bottom (21) of the pouch (20); and iii) the bottom wall (25) of said pouch (20).

14. A golf bag according to (Sg) suitable for containing at least one golf club (Cg) constituted by a shaft (101) and a head (102) secured to a first end (103) of said shaft (101), the second end (104) of said shaft being a free end, said golf bag comprising a pouch (120), at least one receiver tube (130) suitable for receiving the shaft (101) of the golf club (Cg) engaged therein, said receiver tube (130) including a first end (132) and a second end (133) and being shaped wherein when said golf club shaft (101) is engaged in the receiver tube, the golf club head (102) emerges from the first end (132) of said tube, and means for securing said receiver tube (130) to said pouch (120), the golf bag being comprising:

an abutment (141);

means for mounting said abutment (141) to move in translation in said receiver tube (130) relative thereto so as to be capable of occupying all positions between a first position (P1) and a second position (P2);

the first position (P1) being the position in which said abutment (141) is subjected to a presser force less than a predetermined value; and the second position (P2) being the position in which said abutment (141) is subjected to a presser force greater than said predetermined value;

means for mounting said abutment (141) also to be rotatable relative to said receiver tube (130); and means (150) for preventing said abutment (141) from turning relative to said receiver tube (130) when the first position (P1).

15. A golf bag according to claim 14, further comprising means (160) for releasably connecting said shaft (101) with said abutment (141).

16. A golf bag according to claim 15, wherein the means (160) for releasably connecting said shaft (101) with said abutment (141) are constituted by:

a sleeve (161) of inside diameter greater than the diameter of the second end (104) of the shaft (101) said second end is suitable for being engaged in said sleeve (161);

means for securing said sleeve to said abutment (141); and at least one spring (162) secured to the inside wall (163) of said sleeve (161) in such a manner as to be suitable for being subjected to compression when the second end (104) of the shaft (101) is engaged in said sleeve (161)

and for pressing said second end of the shaft against the inside wall of the sleeve (161).

17. A golf bag according to claim 16, wherein the means (160) for releasably connecting said shaft (101) with said abutment (141) comprise at least three springs (162) arranged at substantially one hundred twenty degrees relative to one another on the inside wall (163) of said sleeve (161).

18. A golf bag according to claim 14 wherein the means for mounting said abutment (141) to move in translation in said receiver tube (130) and relative to thereto, and also the means for mounting said abutment (141) to be rotatable relative to said receiver tube (130) are constituted by:

an end wall (131) closing the second end (133) of the receiver tube (130);

a through orifice (134) made in said end wall (131); and a pin (170) secured to said abutment (141), said pin being arranged to be suitable for sliding and pivoting in said through orifice (34).

19. A golf bag according to claim 14, wherein the means (150) for preventing said abutment (141) from turning relative to said receiver tube (130) while in the first position (P1) comprise:

an endpiece (190) having at least one of the following catches on a face (191): a male catch; a female catch; said endpiece being secured to said pin (170);

a ring (192) having a face (193) carrying a plurality of catches complementary to said at least one catch of said endpiece (190); and means for mounting said ring (192) around said through orifice (134), wherein when the abutment (141) is in the first position (P1), the at least one catch of said endpiece co-operates by engaging with one of the catches of the plurality of catches of said ring, and when the abutment (141) is in the second position (P2), the at least one catch of said endpiece (190) does not co-operate by engaging with any of the catches of the plurality of catches of said ring (192).

20. A golf bag according to claim 19, wherein, said endpiece (190) is secured to said pin (170) outside said receiver tube (130), the face (191), including said at least one catch, faces towards said end wall (131), and said ring (192) is secured to said end wall with the face (193) having a plurality of catches complementary to said at least one catch of said endpiece (190) faces the face (191) of said endpiece (190) including said at least one catch.

21. A golf bag according to claim 14, further comprising means for generating a resilient force between said abutment (141) and said receiver tube (130).

22. A golf bag according to claim 21, wherein the means for generating a resilient force between said abutment (141) and said receiver tube (130) are constituted by a helical spring (100) mounted between said abutment (141) and the end wall (131) and surrounding said pin (170).

23. A golf bag according to claim 14, further comprising a pusher (142) constituted by the free end face of the golf club (101) and wherein the second position (P2) of the abutment (141) is the position in which the abutment is subjected to a presser force greater than said predetermined value as applied by the pusher (142).

* * * * *